US005666746A

United States Patent [19]

Pollard

[11] Patent Number: 5,666,746

[45] Date of Patent: Sep. 16, 1997

[54] SPIKED SHOE PROTECTOR WITH ADJUSTABLE STRAP TO ACCOMMODATE DIFFERENT SHOE SIZES

[76] Inventor: Owen Craig Pollard, 2370 Brookhaven Pass, Vista, Calif. 92083

[21] Appl. No.: 496,055

[22] Filed: Jun. 28, 1995

Related U.S. Application Data

[63] Continuation-in-part of Ser. No. 172,176, Dec. 23, 1993, abandoned.

[51] Int. Cl.[6] ..... A43B 3/12; A43B 3/26

[52] U.S. Cl. ..... 36/135; 36/97; 36/7.5

[58] Field of Search ..... 36/135, 97, 7.3, 36/7.5, 7.6, 132

[56] References Cited

U.S. PATENT DOCUMENTS

| | | | |
|---|---|---|---|
| 810,756 | 1/1906 | Hatfield | 36/135 X |
| 1,154,890 | 9/1915 | Sauer | 36/7.6 X |
| 1,204,796 | 11/1916 | Lockwood | 36/7.5 |
| 3,574,959 | 4/1971 | Cicero . | |
| 3,913,243 | 10/1975 | Arnold et al. . | |
| 3,987,510 | 10/1976 | Sbicca . | |
| 4,010,558 | 3/1977 | Slusher . | |
| 4,178,925 | 12/1979 | Hirt | 36/97 X |
| 4,338,733 | 7/1982 | Frechin | 36/7.3 |
| 4,872,273 | 10/1989 | Smeed | 36/135 |
| 5,070,631 | 12/1991 | Fenton . | |

FOREIGN PATENT DOCUMENTS

| | | | |
|---|---|---|---|
| 0582749 | 12/1924 | France | 36/7.5 |
| 0138009 | 2/1930 | Switzerland | 36/7.5 |

*Primary Examiner*—Ted Kavanaugh
*Attorney, Agent, or Firm*—Leonard Tachner

[57] ABSTRACT

An improved spiked shoe protector which provides a protection device to overlay the spikes of spiked shoes to protect the sharp end of the spikes, as well as the underlying surfaces with which the spikes would otherwise come in contact. A significant feature of the present invention is an adjustment strap which permits the protector of the invention to be adjusted in length to accommodate different shoe sizes and which also provides a limited elasticity for easy application to and removal of two separate portions from the shoe in much the same way that ski boots are secured to skis by bindings. The strap is affixed at one end to either a sole or heel portion of the protector and adjustably secured at the other end to the remaining portion.

3 Claims, 5 Drawing Sheets

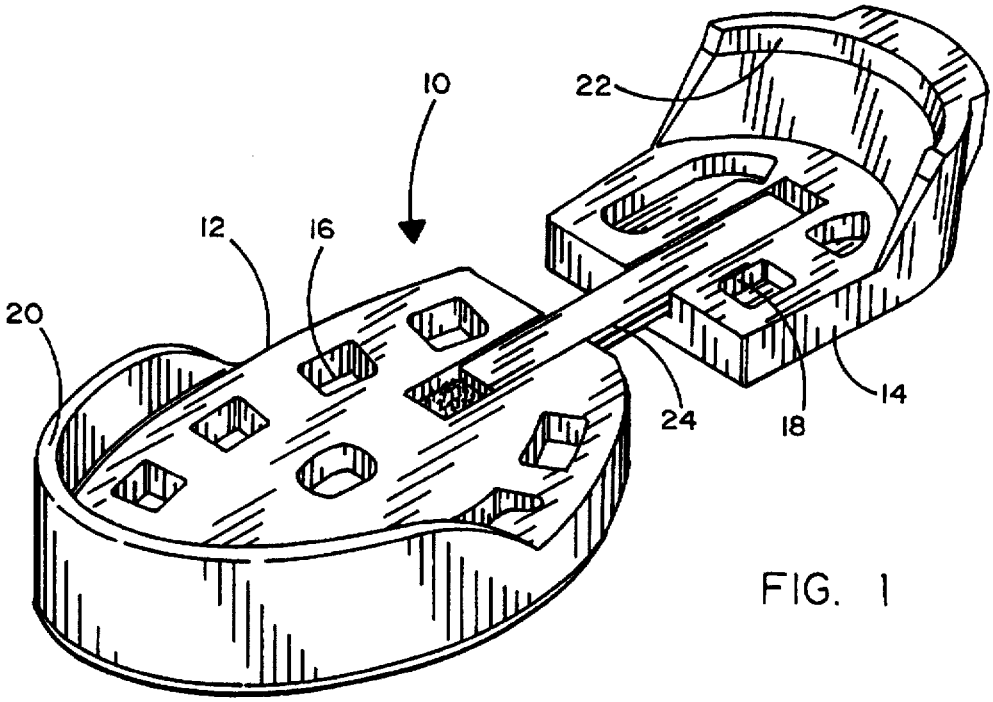
FIG. 1
FIG. 2
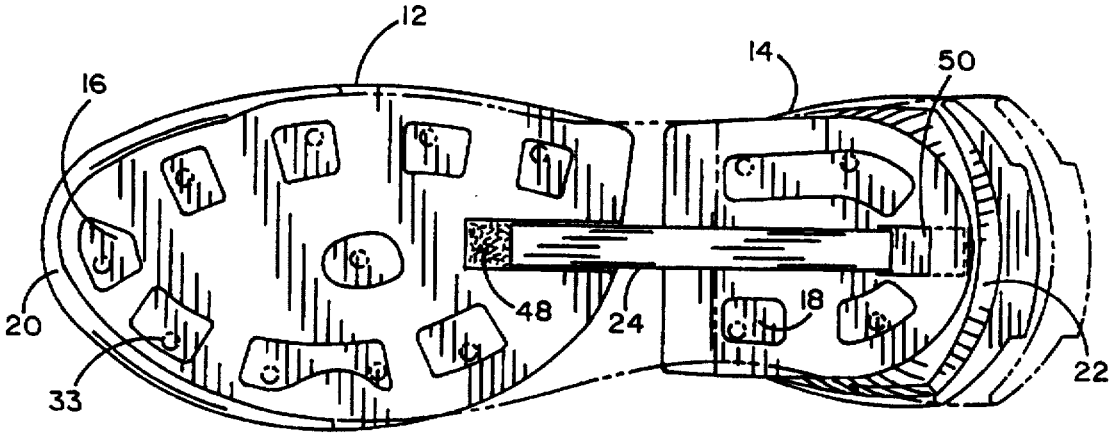

SPIKED SHOE PROTECTOR WITH ADJUSTABLE STRAP TO ACCOMMODATE DIFFERENT SHOE SIZES

CROSS-RELATED APPLICATIONS

This application is a continuation-in-part of patent application Ser. No. 08/172,176 filed Dec. 23, 1993, now abandoned, entitled "SPIKED SHOE PROTECTOR" by inventor Owen Craig Pollard.

FIELD OF THE INVENTION

The present invention relates generally to spiked shoes, such as golf shoes and the like, and more specifically to a protection device deigned to be worn on spiked shoes to protect the spikes, as well as the underlying surfaces which might otherwise be scratched or indented by the spikes in contact with such surfaces.

PRIOR ART

A number of prior U.S. Patents relate to the same general concept of protecting either spikes of spiked shoes or the underlying surfaces which might otherwise be damaged by the spikes coming in contact with such surfaces. By way of example, U.S. Pat. No. 3,574,959 to Cicero, discloses a golf shoe spike guarding shield wherein a plurality of such shields made of rubber or the like, are used on the heels and soles of the shoes to fit closely between and against the spikes and have gripping engagement with the sole portions of the shoes. Unfortunately, the structure of the disclosed golf shoe spike guarding shield doesn't cover all of the spikes on spiked shoes, including golf shoes and is too high and unstable to provide comfortable shoe wear. Furthermore, the disclosed shields are unlikely to provide a safe platform for the spiked shoe wearer, who can easily misstep and fall or otherwise lose balance because of the disadvantageous configuration of such shields.

U.S. Pat. No. 3,913,243 discloses a golf sandal which is also designed for preventing damage to spikes and underlying surfaces and is worn in combination with a spiked shoe, such as a golf shoe and comprises a lower flexible hard rubber sole joined to an upper soft rubber sole. The combination comprises a forward sole portion, the upper sole having a plurality of recessed openings, wherein the spike members of the golf shoe insert downwardly into the recessed openings as the golf shoe engages the upper sole of the golf sandal. The golf sandal is secured to the golf shoe by a plurality of straps, each having a Velcro mating fastening element on opposing strap members, the strap being designed to encircle the golf shoe and the sandal to secure the combination. Unfortunately, this golf sandal, when joined by the straps to the golf shoe, creates an unwieldy and an unattractive combination which is unlikely to meet with commercial success because of the ungainly appearance of that combination. In addition, because of the use of multiple straps, the golf sandal of this patent is time-consuming to install and remove from the golf shoe. Finally, the method of securing the sandal to the golf shoe would permit a degree of relative movement between the shoe and the sandal, particularly if the aforementioned straps are not securely fastened to one another with a great deal of force. Thus, this combination of shoe and sandal appears to be potentially unstable and likely to cause tripping or falling, which could result in injury to the user.

U.S. Pat. No. 4,872,273 to Smeed discloses a two-piece spiked shoe protector, but relies exclusively on strap elasticity for accommodating different shoe sizes thus making it difficult to adjust for small and large shoe sizes. The strap is affixed at both of its ends with no provision for adjustment.

Still another prior art patent, namely U.S. Pat. No. 3,987,510 to Sbicca, discloses a method of making footwear which comprises two components; an upper made from conventional elastic webbing and a sole molded thereto and consisting of an elastomeric plastic composition. The upper embraces and covers a principal portion of the wearer's normal shoe and the sole has cavities for accommodating spikes, cleats and other such devices commonly present on athletic footwear for protecting the underlying surfaces and damage to the spikes. While this particular footwear article overcomes a number of the aforementioned prior art, this patent also discloses a device which is too bulky, too difficult to install and remove and unaesthetically configured, thus making it unlikely to be a commercially viable product.

U.S. Pat. No. 4,010,558 to Slusher discloses a golf rubber overshoe fabricated of flexible rubber or plastic and which fits over a pair of golf shoes, but which provides a clearance for the spikes over which the overshoe is fitted. Thus, unlike the other described art, this particular patent discloses an overshoe which is designed to prevent weathering of the golf shoe, but which is not designed to protect the spikes or the underlying surface with which the spikes come in contact.

U.S. Pat. No. 5,070,631 to Fenton discloses a golf shoe cleat cover having a plurality of cleat gripping members slidably positioned within a groove to conform to the pattern and spacing of the cleats on a golf shoe. This patent describes a number of other prior art patents that relate to the previous attempts to provide golf shoe cleat covers, but which nevertheless suffer deficiencies in the form of unsightly straps and the difficulty and time required to apply and remove, as well as the instability which may cause the wearer to trip and possibly injure himself or herself. This prior art patent discloses a golf shoe cover which attempts to overcome the aforementioned deficiencies by providing a unitary cover which has adjustability to accommodate a wide variety of cleat patterns and spacings and which relies for connection of the cover to the golf shoe on gripping openings which are of lesser diameter than the cleats of the golf shoe. Unfortunately, this device suffers from a number of new disadvantages presented by its purportedly advantageous features. By way of example, the disclosed configuration of cleat gripping members would not accommodate all of the various different arrays of spikes and cleats on golf shoes and other athletic type shoes currently on the market. Perhaps even as significant as that, is the fact that this golf shoe cover would not necessarily readily release the spikes and thus would be difficult to remove from the bottom of the spiked shoe without a great deal of effort. It may even be necessary to remove the golf shoe before removing the cover, thus defeating one of the advantages of wearing a golf shoe or other athletic shoe cover in the first place.

From all of the above, it can be seen that there have been numerous attempts in the prior art to provide a golf shoe or other spike shoe cover or protector, but all of which suffer from one or more significant deficiencies or disadvantages in the form of unappealing aesthetics, instability, inconvenience or incompatibility which have made it more likely that a golfer or other athlete would prefer to sue two pair of shoes, one with and one without spikes to accommodate his or her needs for protecting the spikes and underlying surfaces in travel to or from a place of play, such as a golf course.

Thus, there is still an existing need for an improved spiked shoe protecting device which overcomes all of the aforementioned deficiencies of the prior art, namely a spiked shoe protector which is pleasing in appearance, which accommodates all or most of the variety of spiked patterns currently on the market in golf shoes and other athletic shoes, which is easy and convenient to apply and remove, which when applied, provides a stable base which does not increase the risk of a fall and injury to the wearer, and which provides adequate adjustment to accommodate a large range of shoe sizes.

SUMMARY OF THE INVENTION

The present invention meets the aforementioned need by providing a spiked shoe protector which is aesthetically pleasing when applied to the spiked shoe, which does not provide or require a plurality of highly visible straps overlying the shoe upon which it is applied, which accommodates a variety of different spike patterns commonly available on athletic shoes, including different manufacturers' golf shoes for example. It is easy to apply and easy to remove. It is adjustable in length to accommodate different size shoes and most importantly perhaps, it provides a stable, safe platform when applied to the shoes, so that there is no increase in the risk of tripping, falling and injuring one's self when wearing the spike shoe protector of the present invention.

The invention is, in a preferred embodiment, provided in the form of two portions, namely a sole portion and a heel portion which are joined by an adjustment strap. One strap embodiment has a non-flexible portion and a flexible portion. The strap is positioned in a recess in both the sole and the heel portions of the protector so that it does not interfere with the fit between the protector and the spiked shoe, nor with the comfort of the shoe wearer.

A second strap embodiment has a plurality of eyes adapted to engage a plurality of tabs. The heel portion provides strap threading recesses, one of which provides the tabs to engage the strap eyes. By threading the strap through the recesses so that different eyes engage the tabs, the separation between the heel and sole portions may be readily altered to accommodate different shoe sizes. The strap is marginally elastic so that the heel and sole portions can be further separated to install the protector onto the shoe and then apply tension between the protector and shoe to provide a secure, comfortable, compressive engagement therebetween.

Both embodiments of the adjustment strap are particularly advantageous and innovative in that they provide two significant features of the present invention. One such feature is their adjustability to accommodate different shoe sizes and another is their ability to provide tension between the sole portion and the heel portion which aid in securing the protector to the shoe in combination with toe and heel flanges, each having a respective retaining ridge for engaging the shoe sole and the shoe heel, respectively.

OBJECTS OF THE INVENTION

It is therefore a principal object of the present invention to provide a spiked shoe protector which is adjustable in length for accommodating different shoe sizes and which uses a tension strap for securing a sole portion and a heel portion to the sole and heel of the attached shoe, respectively.

It is another object of the present invention to provide a spiked shoe protector which is extremely easy to apply and remove and which avoids the use of unsightly straps and the like, which would otherwise make the combination of spiked shoe and spiked shoe protector aesthetically unappealing.

It is still an additional object of the present invention to provide a spiked shoe protector which uses a sole portion and a heel portion for providing an extremely stable platform firmly secured to the spiked shoe, which thus avoids increasing the risk of tripping, falling and injury.

It is still an additional object of the present invention to provide a spiked shoe protector which is designed to accommodate a variety of different spike patterns on spiked shoes, as well as different size spiked shoes, so that the protector of the present invention can accommodate a large variety of different manufacturers' spiked shoe patterns and shoe sizes.

It is still an additional object of the present invention to provide a two-piece spiked shoe protector in which a threaded eye-strap permits separation adjustment of the two pieces to accommodate a large range of shoe sizes.

BRIEF DESCRIPTION OF THE DRAWINGS

The aforementioned objects and advantages of the present invention, as well as additional objects and advantages thereof, will be more fully understood hereinafter, as a result of a detailed description of a preferred embodiment when taken in conjunction with the following drawings in which:

FIG. 1 is a three dimensional view of a first embodiment of the spiked shoe protector of the present invention shown fully assembled and ready for application to a spiked shoe;

FIG. 2 is a top view of the first embodiment of the spiked shoe protector of the invention;

DETAILED DESCRIPTION OF A PREFERRED EMBODIMENT

Figure 3:
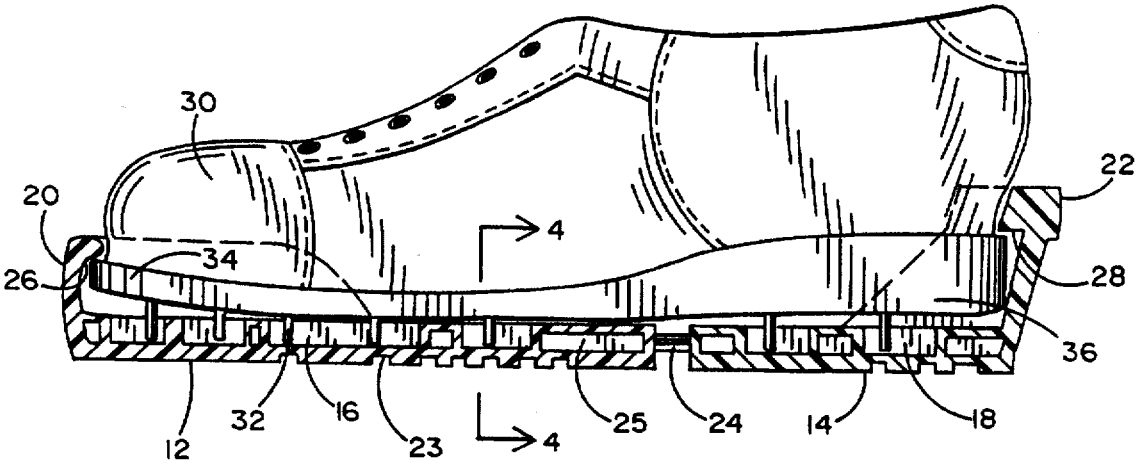
FIG. 3 is a partially cross-sectioned side view of the first embodiment of the spiked shoe protector of the present invention shown installed on a shoe.

Referring now to the accompanying figures, it will be seen that the spiked shoe protector 10 of the present invention comprises a sole portion 12 and a heel portion 14. The sole portion comprises a plurality of spike wells 16 and the heel portion comprises a plurality of spike wells 18. The sole portion also comprises a toe flange 20 and the heel portion also comprises a heel flange 22. Both the sole portion and the heel portion provide in the preferred embodiment, a ribbed bottom surface 23.

The sole portion 12 and the heel portion 14 are interconnected by an adjustment strap 24 the details of which will be more fully understood hereinafter in conjunction with the description of FIG. 5. The sole and heel portions of the present invention may be made of a solid plastic rubber injection molded material, similar to the material used in conventional tire manufacture. In the preferred embodiment shown herein and as seen best in FIGS. 3 and 4, the sole and heel portions are provided with a plurality of hollows 25 to further reduce the weight of the protector 10. The top of the hollows are covered to form a shoe support surface 27, seen best in FIG. 4.

Figure 4:
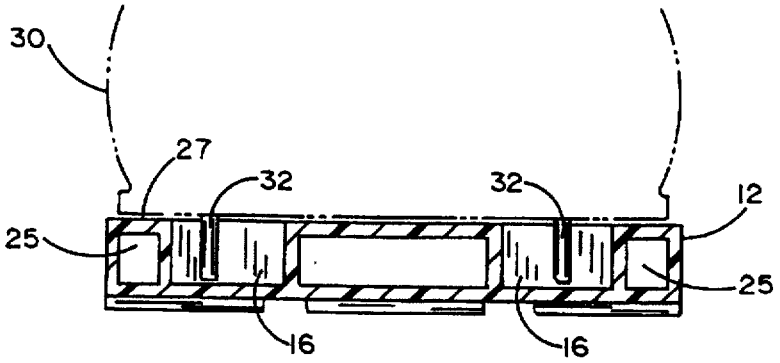
FIG. 4 is a cross-sectional view of the invention taken along lines 4—4 of FIG. 3.

The method by which the protector 10 of the present invention is secured to a spiked shoe, such as shoe 30 shown in FIG. 3, is by means of the toe flange 20 and the heel flange 22 and more specifically by means of a front retaining ridge 26 on toe flange 20 and a rear retaining ridge 28 on heel flange 22. The front retaining ridge 26 is designed to engage the shoe sole 34 and the rear retaining ridge 28 is designed to engage the shoe heel 36, as seen best in FIG. 3. As also seen in FIG. 3, when the spiked shoe protector 10 of the present invention is installed on a shoe 30, the spikes 32 of the shoe rest in the spike wells 16 and 18 of the sole and heel portions respectively. The footprint 33 of each spike 32 of a typical spiked shoe pattern, is shown in the view of FIG. 2. However, it will be observed that the size and shape of the wells 16 and 18 are such that the protector 10 can accommodate a variety of modifications of this particular spike pattern, whereby the actual location of each spike 32 and each well 16 and 18 is not particularly critical, as long as the spike enters the well and is located therein when the protector 10 is secured to the shoe 30.

Figure 5:
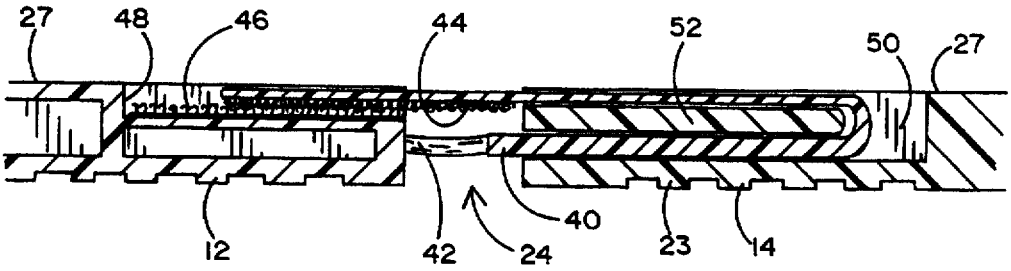
FIG. 5 is an enlarged, partially cross-sectioned view of the first embodiment strap portion of the present invention, showing the manner in which it is installed for adjustment and tension functions described herein.
Figure 6:
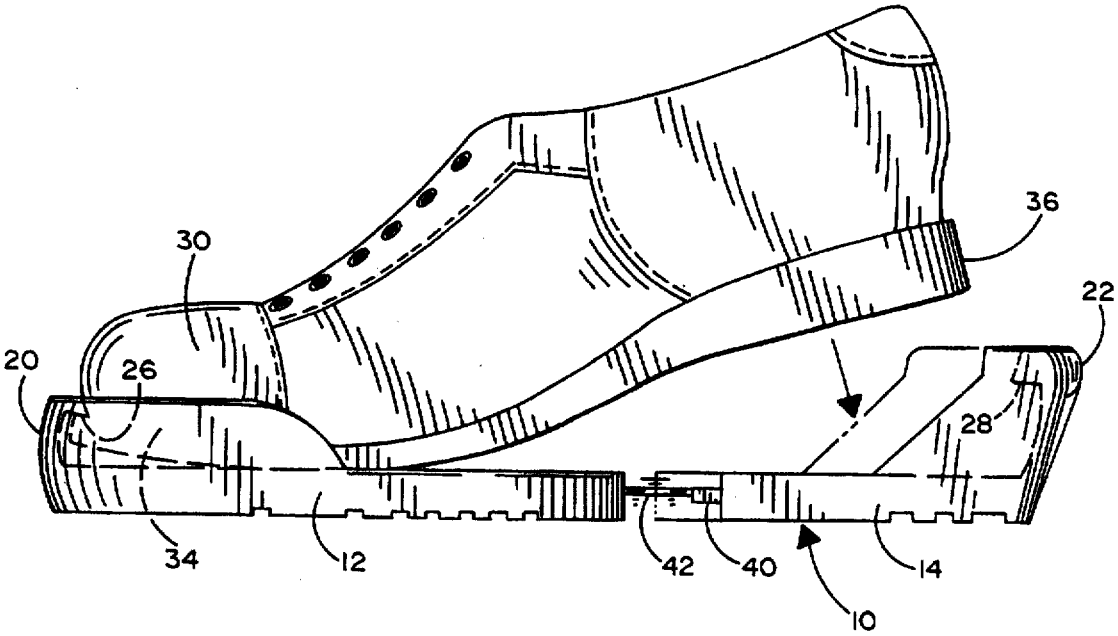
FIG. 6 is a side view illustration of the manner in which the protector of the present invention may be adjusted to accommodate different size spiked shoes using the first embodiment thereof.

The adjustment and tension features of the present invention are best understood by reference to FIGS. 5 and 6. As shown therein, the adjustment strap 24 comprises a non-stretchable portion 40 and a stretchable or elastic portion 42. Such portions may be sewn together or otherwise affixed to one another to form a relatively continuous strap with the end of the stretchable portion 42 being secured to the sole portion 12 of the protector 10, either by means of an adhesive or press-fit engagement that firmly secures the stretchable portion 42 to the sole portion 12.

The non-stretchable portion 40 of adjustment strap 24 is fed into a heel recess 50 in the heel portion 14, between the ribbed bottom surface 23 and a bridge 52. The top of the bridge 52 is recessed from the shoe support surface 27, so that when the non-stretchable portion 40 is folded around the bridge 52 and back towards the sole portion 12, the top of the strap lies substantially flush with the shoe support surface 27. In FIG. 5, it will be seen that the non-stretchable portion 40 of the adjustment strap 24, is sufficiently long to extend beyond the heel portion 14 and onto the sole portion 12, bridging the gap between the sole and heel portions. A terminal segment of the non-stretchable portion 40 of adjustment strap 24, is provided with a Velcro fastening material 44. It will also be seen that the sole portion 12 is provided with a sole recess 48, the bottom of which is provided with mating Velcro fasteners 46, which receive and retain the Velcro fasteners 44 on the terminal segment of the non-stretchable portion of the adjustment strap. Thus, when the adjustment strap is secured in place as shown in FIG. 5, the mating Velcro fasteners 44 and 46 provide a way of securing the terminal segment of the strap 24 to the sole portion 12 within the sole recess 48, where the top of the strap is substantially flush with the adjacent shoe support surface 27.

It will be seen therefore, that the strap 24 provides two significant functions in the present invention. One such function is the adjustment of the distance between the sole portion 12 and the heel portion 14. This distance may be adjusted simply by pulling the Velcro fastening portion of the terminal segment of the strap toward the sole portion 12, around the bridge 52, while moving the heel portion 14 toward the sole portion 12, thereby reducing the gap therebetween. Of course, it will be understood that to increase the distance between the heel portion 14 and the sole portion 12, one may pull those two portions apart, with the strap loosened, so that the non-stretchable portion 40 of the strap 24, will travel around the bridge 52 to permit such an increase in the spacing between the heel and sole portions of the invention.

In practice, it has been found preferable to adjust the gap between the heel and sole portions and the strap position, so that the distance between the toe flange 20 and the heel flange 22, as seen in FIG. 6 is adjusted to be about ¼ of an inch shorter than the overall length of the shoe 30 measured between the front of the shoe sole 34 and the back of the shoe heel 36. In this manner, when the shoe 30 is placed in the spike shoe protector 10, the stretchable or elastic portion 42 of the strap 24 expands, temporarily increasing the gap between the heel portion 14 and the sole portion 12, allowing the shoe to enter and be firmly secured within the protector 10. At this point, the strap 24 performs its second important function of the present invention, namely the function of applying compressive force between the toe flange 20 and the heel flange 22, onto the shoe 30 residing between those flanges. It has been found that a rubberized elastic band material, used for the stretchable portion 42 and that is capable of applying a force of about 3 to 6 pounds, is sufficient to firmly secure the protector 10 to the shoe 30, without risk of inadvertent removal of the protector from the shoe and without affecting the comfort of the wearer. However, it will be understood that because of the adjustability feature of the present invention, the actual force applied between the toe flange 20 and heel flange 22 on the shoe, and particularly on the shoe sole 34 and shoe heel 36, is a matter of personal choice and can be readily modified according to the wearer's preferences.

Figure 7:
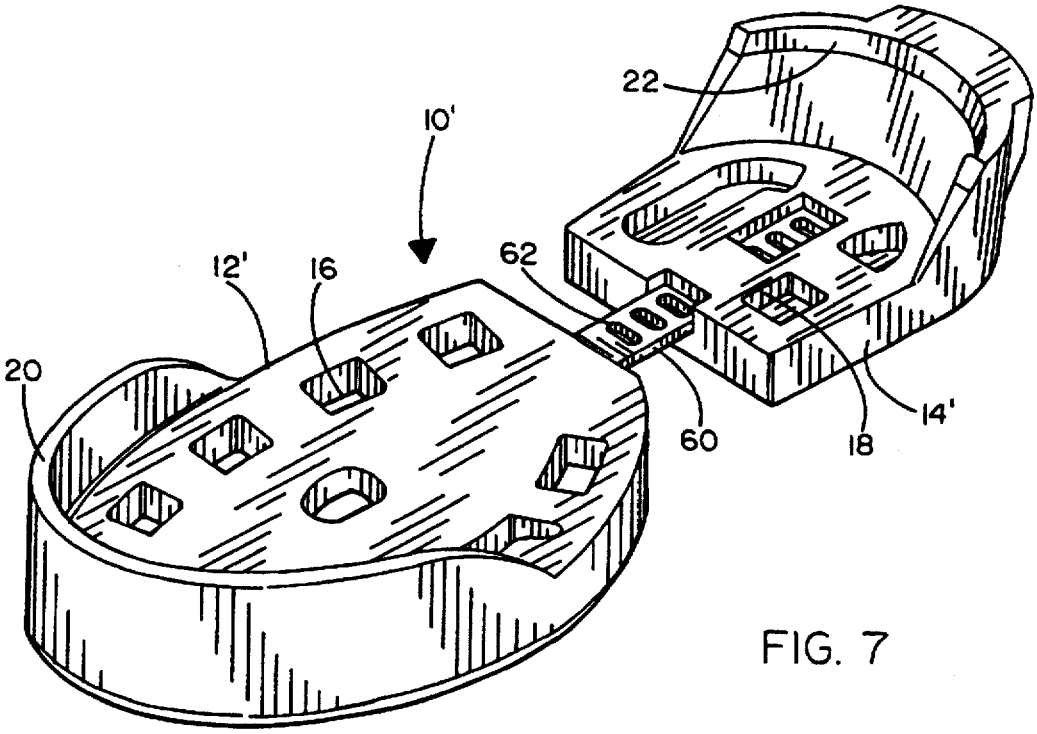
FIG. 7 is a view similar to that of FIG. 1, but illustrating a second embodiment of the invention.
Figure 8:
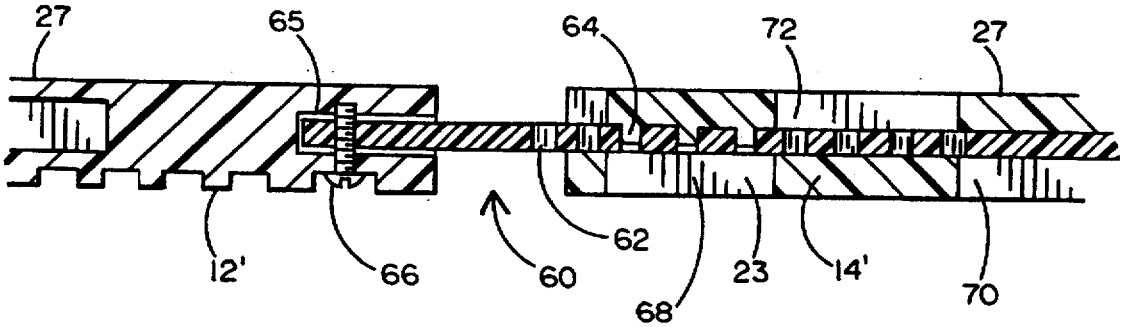
FIG. 8 is a view similar to that of FIG. 5, but illustrating the second embodiment of the invention.
Figure 9:
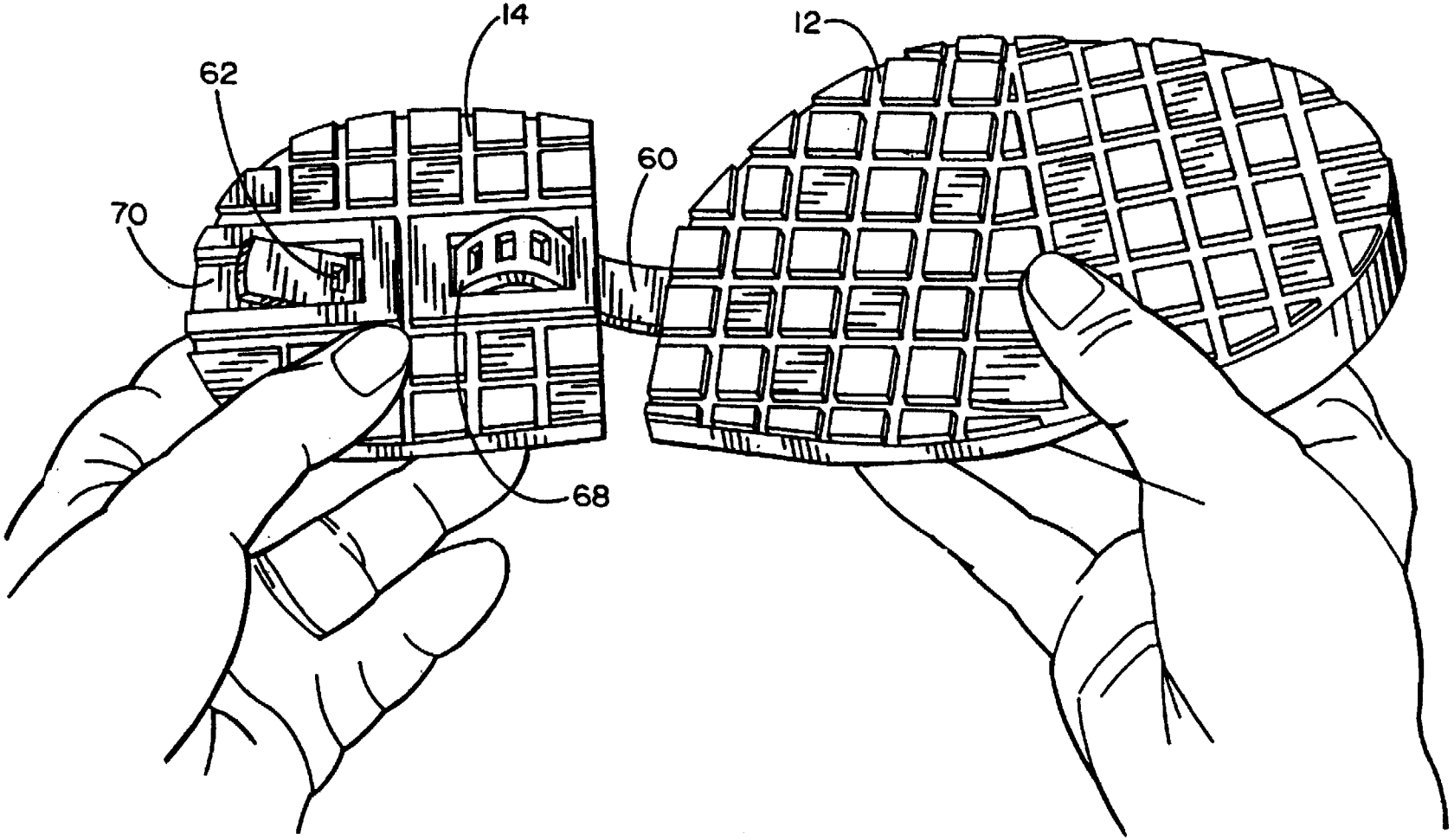
FIG. 9 is a three-dimensional view of the second embodiment illustrating the manner in which the strap may be adjusted.

A second embodiment of the invention is shown in FIGS. 7–9 to which reference will now be made. This shoe protector 10' of this second embodiment is essentially identical to the shoe protector 10 of the first embodiment except for the strap portion. More specifically, protector 10' has a modified sole portion 12', a modified heel portion 14' and a strap 60 having a plurality of eyes 62. The strap 60 is affixed to the sole portion 12' within a strap-retaining recess 65 by a fastener 66. The heel portion 14' provides a front-threading recess, a rear-threading recess 70 and a central threading recess 72. Front-threading recess 68 has a plurality of subtending tabs 64 configured to be received in selected ones of the strap eyes 62. Strap 60 may be threaded through recesses 68, 70 and 72 to the desired extend to select an overall length of protector 10'. A sufficient number of eyes 62 are provided in strap 60 to assure a significant adjustment capability to accommodate a large range of shoe sizes. The strap itself has sufficient rubber-like characteristics to stretch enough to facilitate installation and removal as well as to apply moderate tension on a spiked shoe to assure a secure attachment thereto.

It will now be understood that what has been disclosed herein, comprises an improved spiked shoe protector which overcomes all of the previously noted deficiencies of the prior art. More specifically, the present invention provides a protection device to overlay the spikes of spiked shoes to protect the sharp end of the spikes, as well as the underlying surfaces with which the spikes would otherwise come in contact. As used herein, the term "spikes" includes cleats and other specialty shoes to increase the frictional engagement between the shoe and an underlying surface. There are no unsightly straps to diminish the aesthetics of the combination of protector and shoe. The protector is designed to be applied to the shoe and removed from the shoe easily and quickly and without any significant inconvenience to the wearer. Most importantly, the protector of the present invention provides an extremely stable base that is firmly secured to the shoe and thus minimizes the risk of an unstable shoe platform that might otherwise cause tripping, falling and injury to the wearer. A significant feature of the present invention is an adjustment strap which permits the protector of the invention to be adjusted in length to accommodate different shoe sizes and which also provides a limited elasticity for easy application to and removal of two separate portions from the shoe in much the same way that ski boots are secured to skis by bindings. A preferred embodiment of the strap employs an eye and tab interface wherein the strap may be selectively threaded into the heel portion to vary the gap between the heel and sole portions. Thus, the present invention is aesthetically pleasing, extremely convenient and easy to apply and remove and safe for the user.

Those having skill in the art to which the present invention pertains, will now as a result of the applicant's teaching herein, perceive various modifications and additions which may be made to the invention. By way of example, the particular configuration of the adjustment strap shown herein, may be readily altered, as well as the manner of securing same to the sole and heel portions of the shoe. One such modification may comprise a rigid adjustable strap having a plurality of spaced parallel ridges to provide the adjustment feature and an elastic band portion to provide the compressive force feature of the invention. Thus, it will be understood that all such modifications and additions are deemed to be within the scope of the invention, which is to be limited only by the claims appended hereto and their equivalents.

I claim:

1. An overlaying protector for covering a spiked shoe's spikes; the protector comprising:

a pair of separate cover portions having an upper surface with wells formed therein to receive the spiked shoe's spikes and forming a shoe support surfacer one said cover portion being adapted to mate with and be releasably coupled to a front portion of the spiked shoe and the other said cover portion being adapted to mate with and be releasably coupled to a rear portion of the spiked shoe; and an adjustment strap permanently affixed to one of said cover portions and adjustably affixed to the other of said cover portions for changing a spacing dimension between said cover portions for accommodating different shoe sizes, said adjustment strap having a plurality of serially arranged eyes formed therein, one of said cover portions including means for adjustably affixing said adjustment strap thereto, said means for adjustably affixing including a recess having a bottom surface thereof formed with a plurality of tabs extending therefrom for releasable coupling with selected ones of said plurality of eyes; and wherein said means for adjustably affixing further includes a plurality of additional recesses formed alternately in said upper surface and an opposing lower surface in spaced relationship with said recess having tabs formed on said bottom surface thereof, each of said recesses being in open communication with adjacent others of said recesses for threadedly receiving said adjustment strap therein.

2. A protector for overlaying a spiked shoe's spikes and attachment to the shoe; the protector comprising:

a longitudinally extended sole portion having a toe flange formed on one longitudinal end thereof for engaging a front end of the shoe and having opposing top and bottom surfaces, said sole portion upper surface having at least one spike well formed therein for receiving a respective spike of the shoe;

a longitudinally extended heel portion having a heel flange formed on one longitudinal end thereof for engaging a back end of said the shoe and having opposing top and bottom surfaces, said heel portion upper surface having at least one spike well formed therein for receiving a respective spike of the shoe; and, an adjustment strap having a plurality of sequentially spaced eyes and adjustably connected to both said sole portion and said heel portion for adjusting the distance between said toe flange and said heel flange;

one of said heel and sole portions having a plurality of longitudinally spaced recesses formed alternately in said opposing top and bottom surfaces of said one portion, each of said plurality of recesses being in longitudinal open communication with adjacent others of said plurality of recesses for threadedly receiving said adjustment strap therein, one of said plurality of recesses having a lower surface thereof formed with a plurality of tabs extending therefrom for mating with selected ones of said eyes for selectively securing said strap thereto.

3. An overlaying protector for covering a spiked shoe's spikes; the protector comprising:

a pair of separate longitudinally extended cover portions having opposing upper and lower surfaces, said upper surface having wells formed therein to receive the spiked shoe's spikes and forming a shoe support surface, one said cover portion being adapted to mate with and be releasably coupled to a front portion of the spiked shoe and the other said cover portion being adapted to mate with and be releasably coupled to a rear portion of the spiked shoe; and an adjustment strap permanently affixed to one of said cover portions and adjustably affixed to the other of said cover portions for changing a spacing dimension between said cover portions for accommodating different shoe sizes, said adjustment strap having a plurality of serially arranged eyes formed therein, one of said cover portions including means for adjustably affixing said adjustment strap thereto, said means for adjustably affixing including a plurality of longitudinally spaced recesses formed alternately in said opposing upper and lower surfaces of said cover portion, each of said plurality of recesses being in longitudinal open communication with adjacent others of said plurality of recesses for threadedly receiving said adjustment strap therein, one of said plurality of recesses having a bottom surface thereof formed with a plurality of tabs extending therefrom for releasable coupling with selected ones of said plurality of eyes.

* * * * *